US005697180A

United States Patent [19]

Morizio

[11] Patent Number: 5,697,180

[45] Date of Patent: Dec. 16, 1997

[54] COLLAPSIBLE AND PORTABLE GUN STAND TABLE HAVING ADJUSTABLE LEGS, A FIREARM SUPPORT RAIL, AND STORAGE DRAWERS

[76] Inventor: Joseph Morizio, 8 Dartmouth Dr., Hazlet, N.J. 07730

[21] Appl. No.: 536,518

[22] Filed: Sep. 29, 1995

[51] Int. Cl.[6] ..... F41C 23/00

[52] U.S. Cl. ..... 42/94

[58] Field of Search ..... 42/94; 89/37.04; 248/178.1, 180.1, 183.1, 416, 419, 425, 429

[56] References Cited

U.S. PATENT DOCUMENTS

| | | | |
|---|---|---|---|
| 1,367,353 | 2/1921 | Craig | 89/37.04 |
| 3,012,350 | 12/1961 | Wold | 42/94 |
| 3,041,938 | 7/1962 | Seabrook | 42/94 |
| 3,894,805 | 7/1975 | Middleton | 356/138 |
| 4,007,554 | 2/1977 | Helmstadter | 42/94 |
| 4,026,057 | 5/1977 | Cady | 42/94 |
| 4,506,466 | 3/1985 | Hall | 42/94 |
| 4,545,144 | 10/1985 | Schuster | 42/94 |
| 4,702,029 | 10/1987 | DeVaul et al. | 42/94 |
| 5,070,636 | 12/1991 | Mueller | 42/94 |
| 5,284,280 | 2/1994 | Stonebraker, Sr. et al. | 42/94 |
| 5,419,233 | 5/1995 | Mulvaney | 89/37.04 |
| 5,431,428 | 7/1995 | Marchwiak et al. | 280/655 |
| 5,497,575 | 3/1996 | Fried | 42/94 |
| 5,535,559 | 7/1996 | Hall | 42/94 |

OTHER PUBLICATIONS

Webster's II New Riverside Dictionary, Riverside Publishing Co., pp. 235–236 1994.

*Primary Examiner*—Michael J. Carone
*Assistant Examiner*—Christopher K. Montgomery
*Attorney, Agent, or Firm*—Ezra Sutton

[57] ABSTRACT

A collapsible and portable gun stand table comprising a table having a tabletop with top and bottom surfaces and at least one channel opening formed in the tabletop. An L-shaped, firearm support assembly is provided having a horizontal section and a vertical section wherein the horizontal section is used for supporting a firearm and the vertical section extends through the channel opening. In addition, there is a gear housing for supporting the firearm support assembly on the tabletop and being movable within the channel opening to allow for lateral, vertical, and rotational movement of the firearm support assembly relative to the tabletop. There is also a plurality of adjustable less pivotally attached to the tabletop.

18 Claims, 6 Drawing Sheets

COLLAPSIBLE AND PORTABLE GUN STAND TABLE HAVING ADJUSTABLE LEGS, A FIREARM SUPPORT RAIL, AND STORAGE DRAWERS

FIELD OF THE INVENTION

This invention relates to a collapsible and portable gun stand table for use in target shooting at a shooting range or for hunting of game animals in a game preserve. More particularly, this invention relates to a light-weight gun stand table having adjustable legs, an adjustable firearm support rail movable in all directions, and storage drawers for gun materials.

BACKGROUND OF THE INVENTION

Several types of foldable and portable gun stands, shooting bench rests, shooting platforms, gun sighting devices, shooting support apparatus, and shooting tables for hunting and/or target shooting have been utilized in the past. These types of gun stand supports are desired by sharp shooters, marksmen, or hunters when shooting relatively long distances or when sighting a rifle or pistol for target shooting. These supports usually provide for a very stable reference support on most terrains. The collapsible and foldable nature of gun stand supports provides for easy storage in a vehicle trunk, a storage closet, on a wall, and the like. Also, they may be transported easily through the forest, steep hills or mountains, dirt trails, swamps, and the like, without causing any damage to them.

There remains a need for a collapsible and portable gun stand table that is light-weight for transporting over rough terrain when walking or hiking; is stable when fully or partially assembled for use in hunting and/or target shooting situations; is able to be used by the shooter in several stance positions such as standing, kneeling, prone, crouch and/or sitting on a bench or chair; and is able to have an adjustable firearm support rail having vertical, lateral, and rotational movement.

DESCRIPTION OF THE PRIOR ART

Collapsible and portable gun stand tables of various designs, styles, and materials of construction have been disclosed in the prior art. For example, U.S. Pat. No. 5,419,233 to Mulvaney discloses a portable shooter's bench rest having a forward support member being elevationally positionable above the table panel for resting a gun or rifle barrel. There is also a rear support member being elevationally and laterally positionable above ,the table panel for resting a gun stock butt on the table panel. This prior art structure does not disclose a gun barrel support member having both vertical and lateral movement, nor does this patent disclose a rotatable gun support.

U.S. Pat. No. 4,026,057 to Cady discloses a shooting support for a rifle having a forward cradle structure for the upper stock of a rifle and a rearward cradle structure for the butt stock of a rifle. The forward cradle is vertically and laterally movable relative to an elongated tubular body member. This prior art structure does not disclose a gun barrel or stock support member being rotatable relative to its body member, nor does this patent disclose a tabletop stand having wheels and a drawer for gun materials.

U.S. Pat. No. 5,070,636 to Mueller discloses a gun sighting device having a barrel rest assembly mounted on a longitudinally extending frame. The barrel rest assembly is vertically and laterally movable relative to the frame. This prior art structure does not disclose a gun barrel support member being rotatable relative to the frame member, nor does this patent disclose a tabletop stand having wheels and a drawer for gun materials.

U.S. Pat. Nos. 4,506,466; 4,535,559; 5,284,280; and 5,414,4949 all teach portable shooter's benches, tables, platforms, and the like having only a vertical support member for resting a pistol or rifle barrel on it. These prior art patents do not disclose a barrel support member having vertical, lateral, and rotational movement.

None of the prior art patents disclose the combination of a collapsible, foldable and portable gun stand table structure having a firearm support rail adjustable in the vertical and horizontal planes, and rotatable relative to the support table. None of the aforementioned prior art patents teach the use of a gun stand table which may be utilized in several different stances by a shooter where the gun stand table is in either a fully or partially assembled mode for shooting use. Also, they do not provide a gun stand table which is completely collapsible to allow folding of the legs, the tabletop and the adjustable firearm support rail into a small compact configuration for easy storage.

Accordingly, it is an object of the present invention to provide for a collapsible and portable gun stand table which is light-weight, easily collapsed for storage and easily stabilized in a fully assembled or partially assembled mode for operational use by the shooter when hunting or target shooting.

Another object of the present invention is to provide for a collapsible and portable gun stand table that has collapsible, foldable and adjustable telescoping legs for varying the height of the gun stand table on flat or rough terrain.

Another object of the present invention is to provide for a collapsible and portable gun stand table that has a firearm support rail which is adjustable in the vertical and horizontal planes and is rotatable 360° degrees relative to the support tabletop.

Another object of the present invention is to provide for a collapsible and portable gun stand table having various accessories for ease of operational use by a shooter, such as removable wheels for transporting the table over a variety of terrains, and a plurality of drawers for storing of gun materials.

Another object of the present invention is to provide for a collapsible and portable gun stand table having a center cut-out opening for better positioning and accessing the firearm support rail when using a rifle or pistol, and a center firearm support tray (if needed) as an elevational device for supporting a rifle when hunting which is interchangeable with the center cut-out drawer.

An even further object of the present invention is to provide a collapsible and portable gun stand table that can be mass produced in an automated and economical manner and is readily affordable by the user.

SUMMARY OF THE INVENTION

In accordance with the present invention, there is provided an improved collapsible and portable gun stand table having telescoping, adjustable legs; a firearm support rail assembly; and multiple storage drawers. The collapsible, portable gun stand table consists of a tabletop having slide-track open channels and an off centered cut-out opening formed therein; a plurality of four (4) telescoping, adjustable legs; and a firearm support rail assembly having a detachable gear housing for adjusting the support rail in the vertical and horizontal planes, as well as, having the support rail being rotatable 360° degrees relative to the tabletop surface. Preferably, the tabletop includes two spaced-apart, elongated, rectangularly shaped slide-track channels formed therein, for mounting at least one (1) firearm support rail assembly within the slide-track channels. The tabletop has a centrally located bottom hinge and is attached to the bottom surface for folding in half of the tabletop into two equal sections. This gives the tabletop the ability to be folded into a small compact configuration by a user, such that when the tabletop sections are folded, they are adjacent to each other.

The tabletop has various accessories for the convenience of the user, such as removable wheels for transporting the collapsed gun stand table over a variety of terrains; a center and front storage drawers for the storing of gun materials; a pair of removable rubber bumpers having treads for stabilizing the tabletop when it is used in the partially assembled state; and a liquid level sight-glass component for leveling the tabletop to a horizontal plane when adjusting the telescoping legs on an uneven terrain.

The tabletop, storage drawers and center tray can be made from materials such as plastic, fiberglass, and aluminum for its light weight, durability, and strength of construction given to these component parts when using the aforementioned materials. The wheels can be made from rubber, or a pliable, flexible plastic for good traction. The tabletop can have various colors and/or camouflage patterns imprinted or painted on the top surface and perimeter walls for disguising the gun stand table when used for hunting in the woods. The telescoping, adjustable legs and their component parts can be made from materials such as plastic, fiberglass, and aluminum and have matching colors and/or camouflage patterns imprinted or painted thereon, so as to match the tabletop's color or design schemes previously mentioned.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
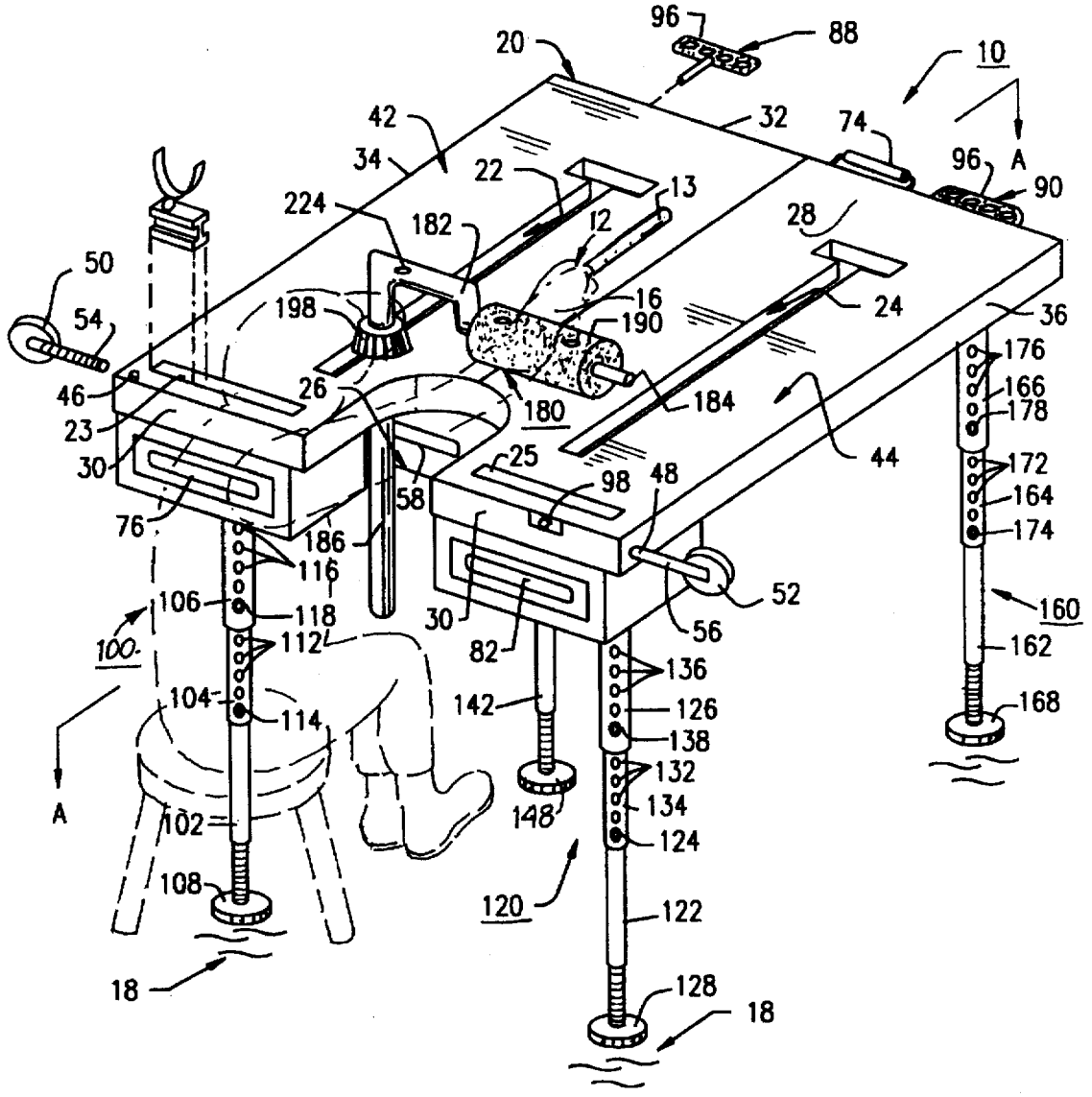
FIG. 1 is a perspective view of the collapsible and portable gun stand table of the present invention showing it in the assembled and operational mode.
Figure 2:
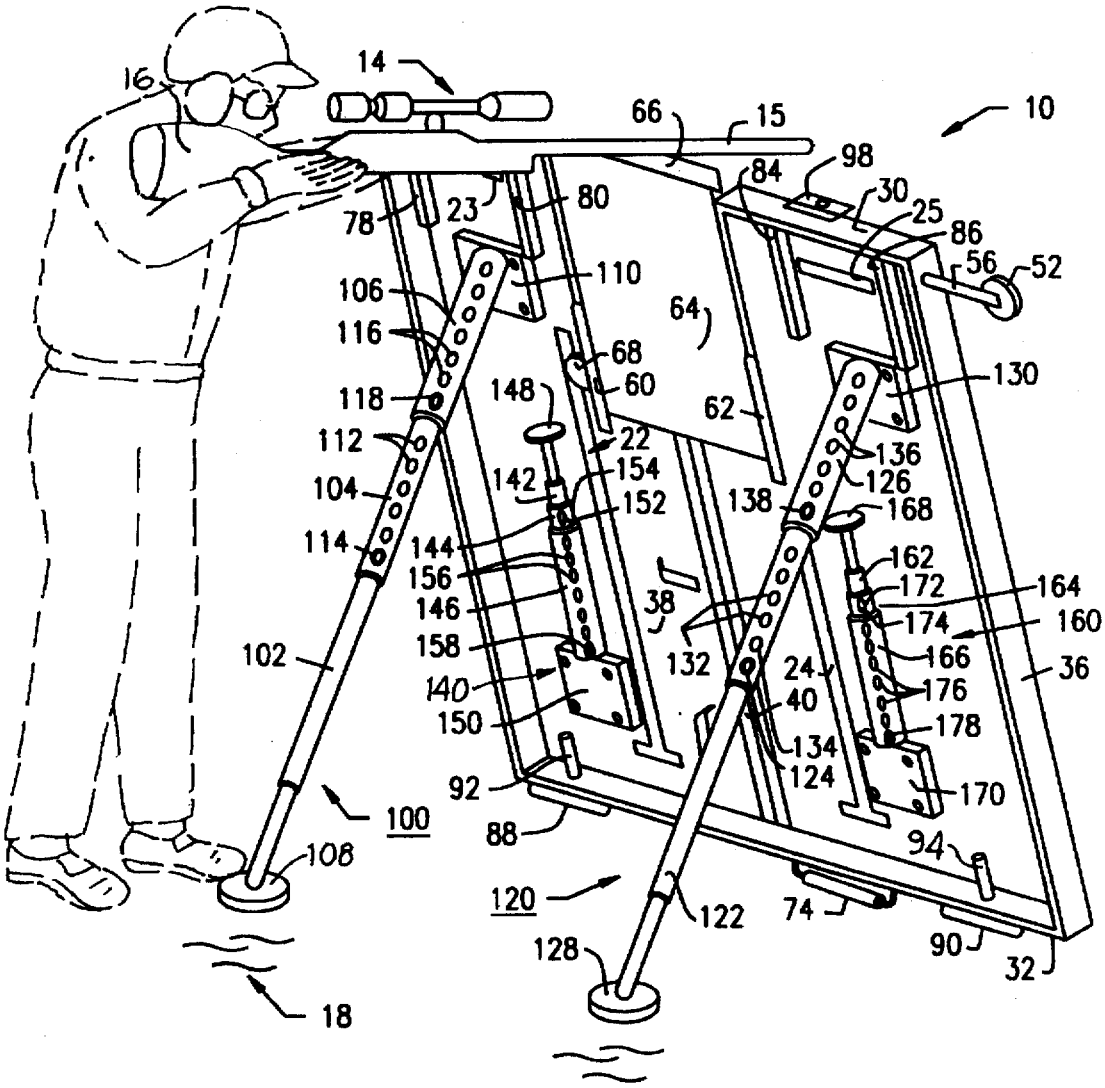
FIG. 2 is rear elevational view of the collapsible and portable gun stand table in a partially opened state but in an operational mode for hunting and/or target shooting showing the positioning of the support legs, and the center elevational tray used for sighting a firearm.
Figure 3:
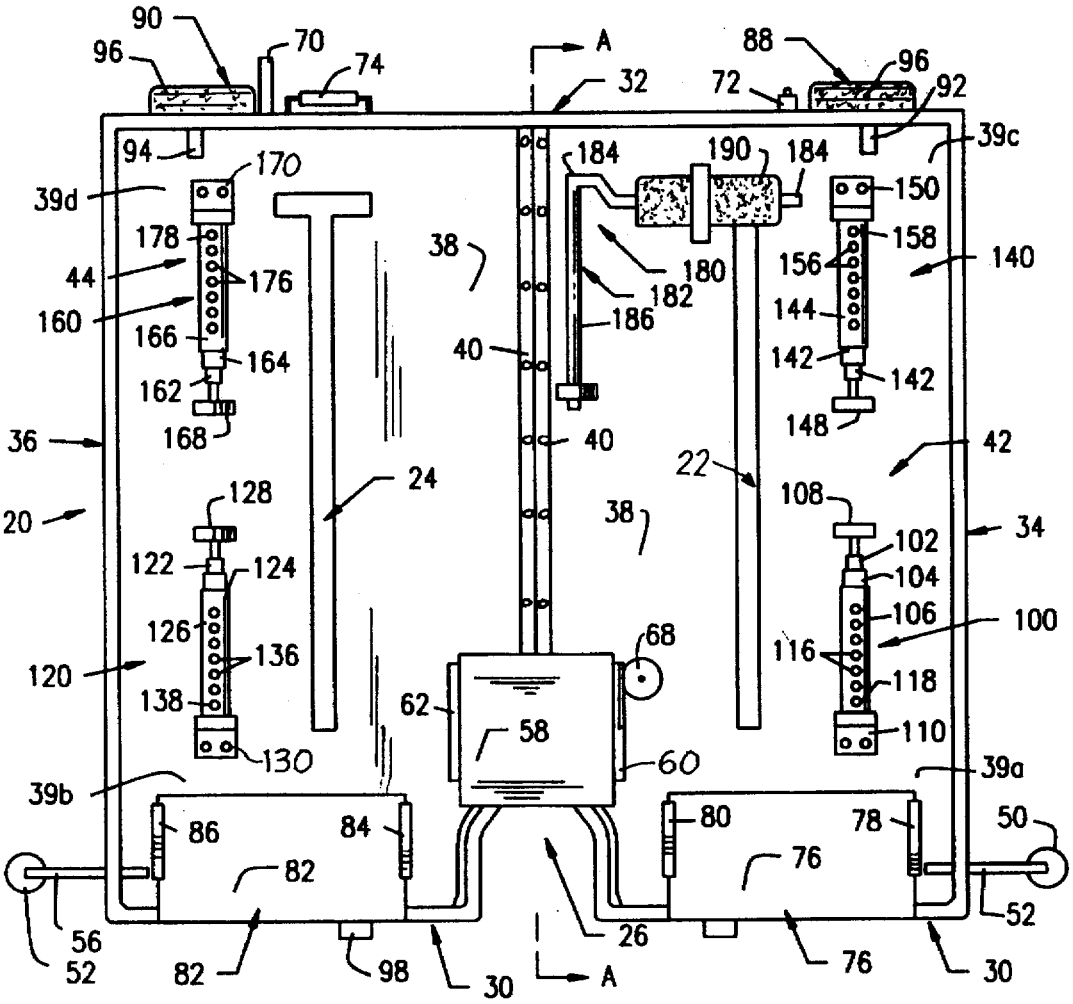
FIG. 3 is a bottom plan view of the collapsible and portable gun stand table in a non-operational mode showing the support legs, drawers, and support rail gear components.
Figure 4:
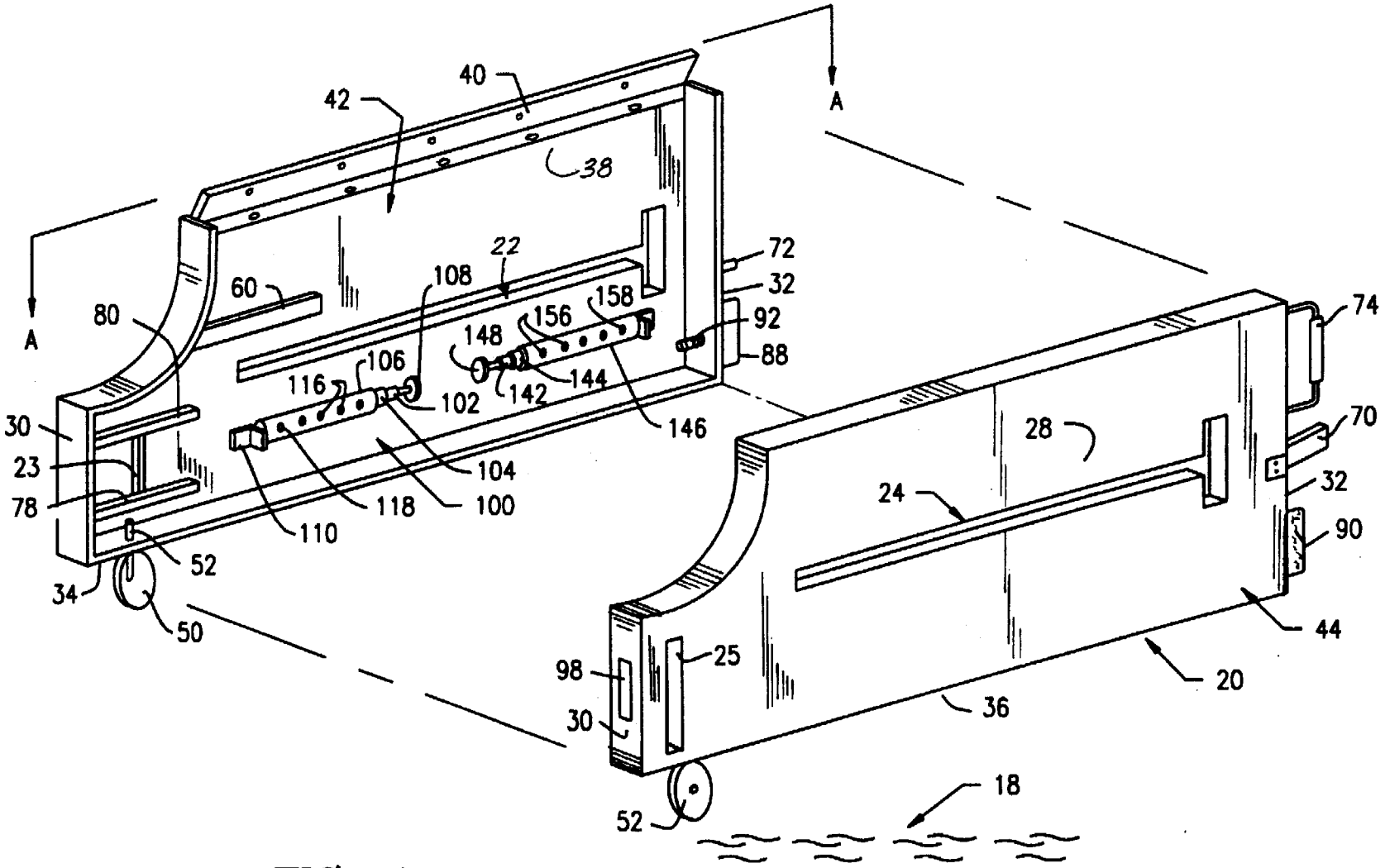
FIG. 4 is an exploded perspective view of the collapsible and portable gun stand table in a fully closed and non-operational mode showing a small compact configuration for transporting over a variety of terrains having the removable wheels in place.
Figure 5:
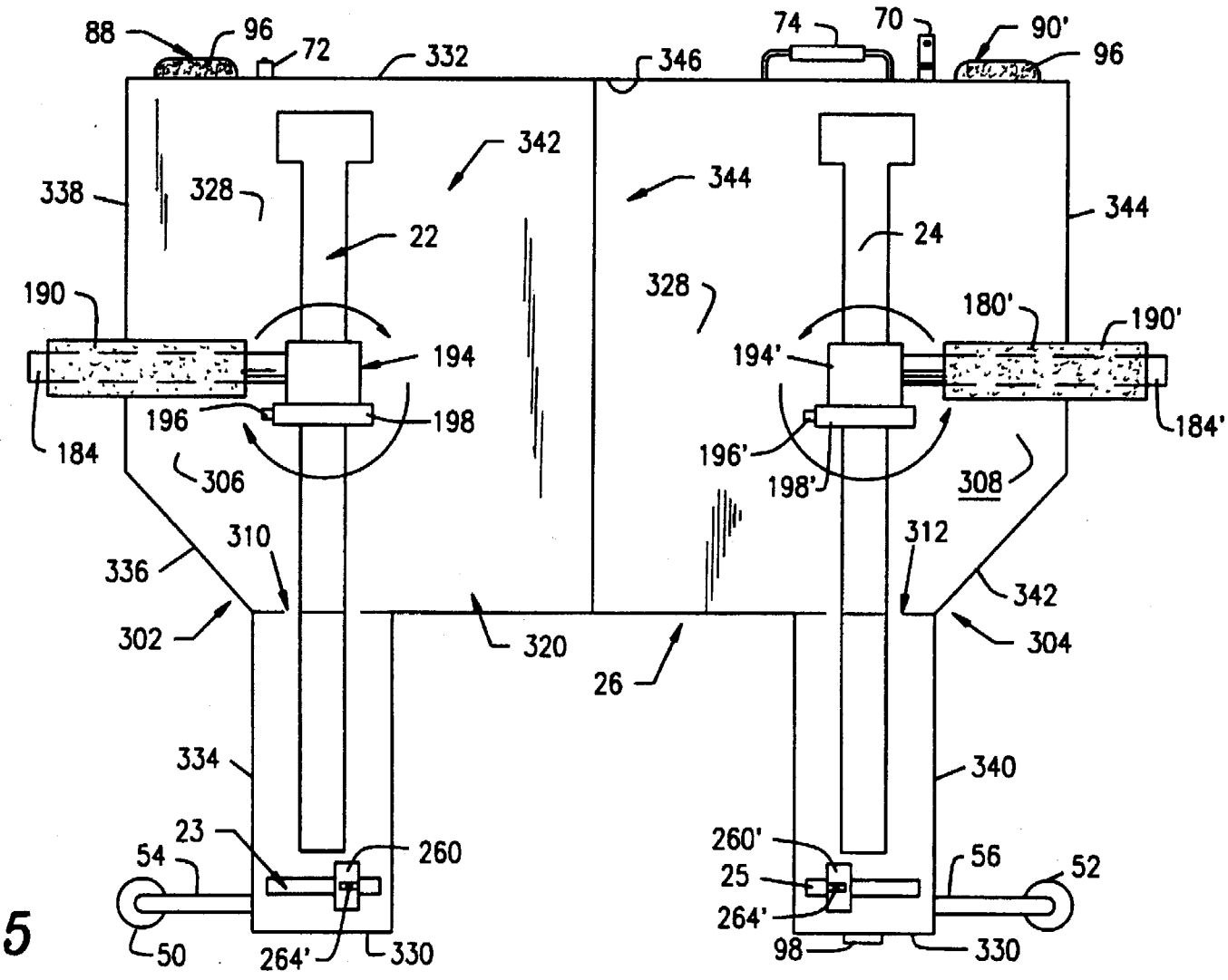
FIG. 5 is a top plan view of the alternate embodiment showing the collapsible and portable gun stand table in a fully opened and operational mode showing dual firearm support rails.

The preferred embodiment of the present invention provides for a collapsible, portable gun stand table 10, as represented in FIGS. 1 through 6. FIGS. 1 and 5 show the gun stand table 10 in a fully opened position and in an operational mode for either target shooting and/or hunting. FIG. 2 shows the gun stand table 10 in a partially assembled state and in an operational mode for either target shooting and/or hunting. FIG. 4 shows the gun stand table 10 in a collapsed state, and in a compact configuration, ready to be transported over any type of terrain 18. The collapsible, portable gun stand table 10 comprises a tabletop 20 having slide-track channel openings 22 and 24, and an off centered cut-out opening 26; a plurality of four (4) telescoping, adjustable legs 100, 120, 140, and 160; and a firearm support rail assembly 180 having a detachable gear housing 194 for adjusting the support rail 180 in the vertical and horizontal planes, as well as, having the support rail 180 being rotatable 360° degrees relative to the tabletop 20, as depicted in FIG. 1.

Tabletop 20 has essentially a square shape, but can be rectangular in shape, consisting of a top surface 28 having integrally attached front, rear and side perimeter walls 30, 32, 34, and 36 and a bottom surface 38. Tabletop 20 includes two spaced-apart, elongated, rectangularly shaped slide-track channels 22 and 24 formed therein, on top surface 28, each for mounting at least one (1) firearm support rail assembly 180 within channel 22 or 24. Tabletop 20 also includes two spaced-apart, rectangular shaped slide-track channels 23 and 25 formed therein, on top surface 28, each for mounting at least one (1) buttstock support assembly 260. Channels 23 and 25 are perpendicular to slide-track channels 22 and 24 and are adjacent to the front perimeter wall 30, as shown in FIG. 1 of the drawings. Tabletop 20 also includes an off-centered cut-out opening 26 located on the top surface 28 being adjacent to the front perimeter wall 30 for allowing the torso portion of the user to have closer access to the firearm support rail 180 when using it to fire shots from a pistol 12 or rifle 14 during target shooting practice or hunting. Tabletop 20 has a centrally located bottom hinge 40 located on bottom surface 38, along center line A—A, for folding tabletop 20 into two halves or tabletop sections 42 and 44, as depicted in FIGS. 1 and 3 of the drawings. This gives the tabletop 20 the ability to be folded into a small compact configuration, such that when the tabletop sections 42 and 44 are folded, they are adjacent to each other, as depicted in FIG. 4.

Tabletop 20 has various accessories for the convenience of the user, such as removable wheels 50 and 52 for transporting the collapsed gun stand table 10 over a variety of terrains 18; a center and front storage drawers 58, 76, and 82 for the storing of gun materials; a pair of removable rubber bumpers 88 and 90 having treads 96 for stabilizing the tabletop 20 when it is used in the partially assembled state, as depicted in FIG. 2; and a liquid level sight-glass component 98 for leveling tabletop 20 to a horizontal plane when adjusting legs 100, 120, 140, and 160 on an uneven terrain 18. The center storage drawer 58 and both left and right front drawers 76 and 82 are held in place by slidable drawer mounting brackets 60, 62, 78, 80, 84, and 86, located on the bottom surface 38 of tabletop 20, as depicted in FIG. 3. The level sight-glass 98 is integrally attached to the front perimeter wall 30, as shown in FIGS. 1, 2, and 3 of the drawings. The aforementioned drawers 58, 76, and 82 can be removed, if necessary, when using the gun stand table 10 for hunting purposes in the woods, as shown in FIG. 2 of the drawings.

Tabletop 20 also includes a clasp 70 and clasp holder 72 for closing and keeping shut both tabletop sections 42 and 44 of tabletop 20, when it is in its collapsed configuration; and a handle 74 for pulling the gun stand table 10 over a variety of terrains 18; as shown in FIGS. 3 and 4 of the drawings. Clasp 70, clasp holder 72 and handle 74 are all located on the rear perimeter wall 32.

Figure 6:
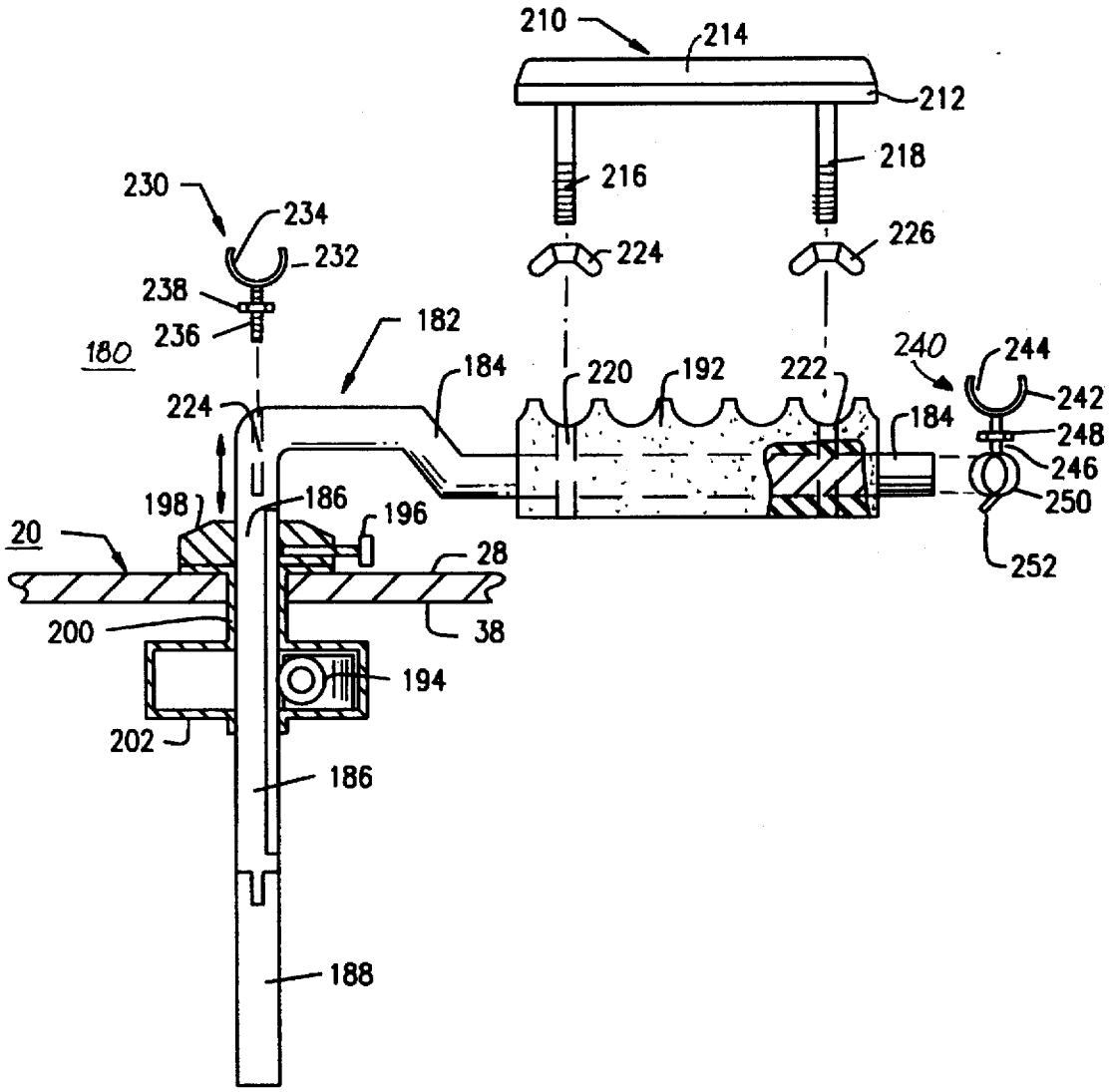
FIG. 6 is a side elevational view of the firearm support rail assembly and support rail gear housing showing the component parts in an operational mode.

Tabletop 20 further includes a center support rail tray 64 having a gear adjustment component 68 for the elevational gun sighting of a pistol 12 or rifle 14 when using the gun stand table 10 in a partially assembled state, as depicted in FIGS. 2, 6, and 7. Center support rail tray 64 has a padded front edge 66 for the placement of a pistol or rifle barrel 13 or 15 on the padding 66. Center tray 64 is interchangeable with center storage drawer 58. Also, center support rail tray 64 uses the same slidable mounting brackets 60 and 62 in conjunction with the gear adjustment component 68 located on the bottom surface 38 and adjacent to the right mounting bracket 62, as depicted in FIG. 2.

Tabletop 20, storage drawers 58, 76, 82 and center support rail tray 64 can be made from materials such as plastic, fiberglass, and aluminum for its light weight, durability, and strength of construction given to these component parts, when using the aforementioned materials. The wheels 50 and 52 can be made from rubber, or a pliable, flexible plastic for good traction. Tabletop 20 can have various colors and/or camouflage patterns imprinted or painted on the top surface 28 and perimeter walls 30, 32, 34, and 36 for disguising gun stand table 10 when used for hunting in the woods.

Transporting wheels 50 and 52 have wheel shafts 54 and 56 for detachably inserting into shaft openings 46 and 48 located on the left and right side perimeter walls 34 and 36. Stabilizing rubber bumpers 88 and 90 have shafts 92 and 94 for detachably inserting into shaft openings 93 and 95 located at opposite ends of the rear perimeter wall 32.

The plurality of telescoping, adjustable legs 100, 120, 140, and 160 consist of lower and middle telescoping tubular sections 102 and 104, 122 and 124, 142 and 144, and 162 and 164 mounted inside the outer leg supports 106, 126, 146, and 166, respectively. At the lower ends 107, 127, 147, and 167 of respective telescoping leg sections 102, 122, 142, and 162 there are connectedly attached, adjustable castor components 108, 128, 148, and 168 for leveling the adjustable legs 100, 120, 140, and 160 to a given incline of terrain 18, as shown in FIGS. 1 and 2. At the upper ends 109, 129, 149, and 169 of the respective outer leg support sections 106, 126, 146, and 166 there are pivotal mounting brackets 110, 130, 150, and 170 for pivotally attaching the adjustable legs 100, 120, 140, and 160 to the corner areas 39*a*, 39*b*, 39*c*, and 39*d* of tabletop 20, as shown in FIG. 3. There are a plurality of adjustment hole openings 112, 132, 152, and 172 having retractable adjustment buttons 114, 134, 154, and 174 for adjusting the leg height of the lower telescoping leg sections 102, 122, 142, and 162 of adjustable legs 100, 120, 140, and 160. There are also a plurality of adjustment hole openings 116, 136, 156, and 176 having retractable adjustment buttons 118, 138, 158, and 178 for adjusting the leg height of the middle telescoping leg sections 104, 124, 144, and 164 of adjustable legs 100, 120, 140, and 160.

The telescoping, adjustable legs 100, 120, 140, and 160 and their component parts can be made from materials such as plastic, fiberglass, and aluminum and have matching colors and/or camouflage patterns imprinted or painted thereon so as to match the color or design schemes of tabletop 20.

The firearm support rail assembly 180, as depicted in FIG. 6, consists of an L-shaped cylindrical housing 182 having an integrally connected horizontal rail section 184 and vertical rail section 186, and a detachable vertical rail section 188 for extending the height of firearm support rail 180 when the shooter is in a standing position. Horizontal rail section 184 includes a cylindrical padded collar 190 or a padded shaped collar 192 for holding the contoured shape of a rifle stock 16 of rifle 14 when the user is shooting in a standing, sitting, kneeling, crouching, or prone position. The support rail assembly 180 also includes a gear housing 194 having a locking mechanism 196 for keeping the vertical rail sections 184 and 188 at a required height and/or at a required distance along tracking channels 22 or 24 by the user, for properly positioning a firearm 12 or 14 on support rail 180. Gear housing 194 has an integrally attached upper section 198, a middle section 200 and a lower section 202 for positioning gear housing 194 about vertical rail sections 184 and 188. Gear housing upper section 198 is located and positioned above top surface 28; and the gear housing lower section 202 is located and positioned below bottom surface 38; whereas, the gear housing middle section 200 straddles the slide-track channel 22 or 24, as shown in FIG. 5. Gear housing 194 is used for the vertical, lateral, and rotational movement of the firearm support rail 180 within slide-track channel 22 or 24 relative to the tabletop 20. The firearm support rail 180 and gear housing 194 may be made from materials like aluminum, stainless steel, or a heavy duty plastic.

The firearm support assembly 180 also includes various accessories for the convenience of the user, such as a pistol perch 210, a cradle mount 230, and a clamp cradle mount 240. The pistol perch 210 includes a rectangular mounting plate 212 having an integrally attached rectangular padded cushion 214 for placing a pistol barrel 13 or handle 16 thereon by the shooter; and two perch shafts 216 and 218 for mounting the pistol perch 210 into respective perch shaft holes 220 and 222 located within the horizontal section 184 of firearm support 180, as depicted in FIG. 6, and is held in place with locking nuts 224 and 226.

The cradle mount 230 includes a Y-shaped frame 232 having a cradle section 234 for supporting a pistol barrel 13 or rifle barrel 15; and a threaded shaft component 236 having a locking bolt 238. The threaded shaft 236 is mounted within a shaft hole 224 located on the horizontal bar 184 above the upper gear housing section 198 of support arm 180, as shown in FIG. 3. Cradle mount 230 can pivotally rotate 360° in either direction and may be held in place by the locking bolt 238.

The clamp cradle mount 240 includes a frame component 242 having a cradle section 244 for supporting a pistol barrel 13 or rifle barrel 15, a threaded shaft component 246, a locking bolt 248, and a clamp component 250 having a clamping lock device 252 attached thereto, as shown in FIG. 3. The clamp component 250 is mounted on the end section of the horizontal bar section 184 and is held in place by the clamping lock device 252. Cradle mount 240 can pivotally rotate 360° in either direction and may be held in place by the locking bolt 248.

The buttstock support assembly 260 includes a Y-shaped frame 262 having a cradle section 264 for supporting the rifle stock 16, a threaded shaft component 266 having a locking bolt 268, and a housing component 270 having front and rear U-shaped channels 272 and 274 for sliding housing 270 within channel openings 23 and 25. Housing component 270 also includes a locking brake 276 for holding in place buttstock support assembly 260 when in use by a shooter, as shown by FIG. 1 of the drawings. The buttstock support assembly 260 may be used in conjunction with the firearm support assembly 180 such that the user places the rifle buttstock 16 in the cradle section 264 and the rifle barrel 15 on padded collar 190 when firing-off shots from rifle 14.

The physical measurements of the gun stand table 10 in a fully opened mode include the tabletop 20 being a 36 inch square with perimeter walls 30, 32, 34, and 36 measuring 1½ inches in width. The tabletop 20 has a thickness dimension in the range of ¼ inch to ½ inch. The telescoping legs 100, 120, 140, and 160 in a fully retracted position have a height measurement of 17 inches and when in the fully extended position have a height measurement of 54 inches. The firearm support rail 180 can be raised from 1 inch above tabletop 20 to a height of 24 inches above tabletop 20. Thus, gun stand table 10 can have an extended height measurement of 78 inches above ground level 18 for a user who is in a standing position. The diameter of support rail housing 182 measures 1½ inches in width.

The slide-track channels 22 and 24 have a width measurement of 2 inches and a length measurement of 28 inches. The off-centered cut-out opening 26 has a width measurement of 18 inches and a depth measurement of 12 inches.

In a collapsed and closed configuration, as shown in FIG. 4, the gun stand table has a width measurement of 18 inches, a length measurement of 36 inches, and a thickness of 3 inches for ease of storage.

DETAILED DESCRIPTION OF AN ALTERNATE EMBODIMENT

An alternate embodiment of the collapsible, portable gun stand table 10 of the present invention is depicted in FIG. 5 of the drawings. All aspects of the alternate embodiment of the gun stand table 300 are the same as the preferred embodiment of gun stand table 10, except for the shape and size of tabletop 320, which is different. Gun stand table 300 lends itself for use by multiple shooters being able to utilize the tabletop 320 at the same time because of its shape.

SECOND EMBODIMENT

As shown in FIG. 5, the tabletop 320 of gun stand table 300 is similar in shape and size to tabletop 20, except for the two angled cut-outs 302 and 304 of the front wall 330. Cut-outs 302 and 304 receive the torso of the shooter. These angled cut-outs 302 and 304 define elbow support areas 306 and 308 between lines 310 and 312, adjacent to the cut-outs 302 and 304, and the respective firearm support arms 180 and 180'. These angled cutouts 302 and 304 allow the shooter's torso to move closer to the respective firearm support arms 180 and 180', so the shooter can place his/her elbows on support areas 306 and 308 of top surface 328 of tabletop 320. When using the angled cut-outs 302 and 304, the shooter positions the firearm support arms 180 and 180', as shown in FIG. 5, such that the support arms 180 and 180' are pivotally rotated 180° degrees, so that the horizontal sections 184 and 184' are pointing outwardly from support areas 306 and 308 of tabletop 320.

Tabletop 320 consists of a top surface 328 having integrally attached front, rear, side perimeter walls 330, 332, 334, 336, 338, 340, 342, and 344 and a bottom surface 346. Tabletop 320 can be folded into two equal sections 342 and 344. In the alternate embodiment, the gun stand table 300 only allows for a single center storage drawer 58 because of the shape of tabletop 320.

Tabletop 320 in a fully opened mode has the following physical measurement: The front perimeter wall 330 measures 28 inches across in width, the rear perimeter wall 332 measures 36 inches across in width, side walls 334, 340 measure 12 inches in length, angled side walls 336, 342 measure 5⅔ inches in length and side walls 338, 344 measure 20 inches in length.

Alternate embodiment 300 operates in the exact same manner as the preferred embodiment of gun stand table 10.

OPERATION OF THE PRESENT INVENTION

The collapsible and portable gun stand table 10 is readily put into operational use from a collapsed mode by initially removing the clasp 70 from clasp holder 72 and opening tabletop sections 42 and 44 of tabletop 20 into its fully opened square configuration. Tabletop 20 is then held by the user, by one of its perimeter walls 30, 32, 34, or 36, where the bottom hinge 40 is locked in place. Then the telescoping and adjustable legs 100, 120, 140, and 160 are unfolded to a 90° angle relative to tabletop 20 and the mounting brackets 110, 130, 150, and 170 are also locked into place. The gun stand table 10 is then uprighted into position, such that tabletop 20 is in a horizontal plane. The telescoping leg sections 102, 104, 122, 124, 142, 144, 162, and 164 are then adjusted to a desired height by the use of the retractable adjustment buttons 114, 118, 134, 138, 154, 158, 174, and 178. Next, the user then can fine tune the horizontal plane of tabletop 20 by using the sight level 98 in conjunction with each of the castor components 108, 128, 148, and 168 for leveling (raising or lowering) the adjustable legs 100, 120, 140, and 160 to the given incline of terrain 18 being used by the shooter, for a given desired height. The desired height level is dependent upon whether the user wants to be in a prone, crouching, kneeling, sitting, or standing position for target shooting, as shown in FIG. 1.

The user then inserts the vertical section 186 of the firearm support rail 180 into the support rail gear housing 194 and the user then further adjusts for a given height desired and locks that height into place by locking mechanism 196. If additional height is needed for the support rail 180 by a user, the detachable vertical section 188 can be attached to vertical section 186, which then can be vertically raised to a new height where the user is usually in a standing position. Next, the user can further adjust the firearm support rail 180 for the lateral movement of gear housing 194, forward or backward within the slide-track channels 22 or 24. The gear housing 194 is locked into place by locking mechanism 196 for the desired depth on tabletop 20, depending upon whether a pistol 12 or rifle 14 is being used, as shown in FIG. 1. If needed, the firearm support rail 180 can be rotated 180° degrees away from tabletop 20 and used in that position for target shooting. Channel 22 or 24 may be used depending upon whether the user is left or right handed. In addition, both channels 22 and 24 could be used at the same time, if an additional support rail 180 is used. During use, a firearm 12 or 14 is placed on support rail 180.

In another operational configuration, as shown in FIG. 2, tabletop 20 is fully opened to the square configuration and put on its front perimeter wall 30 edge, so that the stabilizing rubber bumpers 88 and 90 are attached to the shaft openings 93 and 95 via bumper shafts 92 and 94 on rear perimeter wall 32. Tabletop 20 is then turned 180°, such that the stabilizing bumpers are in contact with the ground 18, where the left and right front legs 100 and 120 are unfolded and angled downwardly between 30° to 45° degrees from bottom surface 38 and locked into place at the desired angled as needed. The telescoping sections 102, 104, 122, and 124 are further extended outwardly and are brought into contact with the ground, as shown in FIG. 2.

Next, the center support rail tray 64 is slid into the drawer brackets 60 and 62 and is adjusted to a desired elevational height for rifle 14 sighting by gear adjustment component 68, where rifle barrel 15 is placed on the padded front edge 66 and is readied for firing on game animals in a hunting situation. When gun stand table 10 is in this configuration, as depicted by FIG. 2, tabletop 20 also acts as a protective barrier from charging animals, i.e. a bear, boar, or moose, etc. or from errant shots, bullets, or arrows from other hunters.

To collapse and fold-up gun stand table 10, the support rail 180 is removed from gear housing 194, and tabletop 20 is put on its sidewall 34 or 36 where the telescoping sections 102, 104, 122, 124, 142, 144, 162, and 164 are released and retracted into the outer support legs 106, 126, 146, and 166. The legs 100, 120, 140, and 160 are then folded inwardly to bottom surface 38, as shown in FIG. 4, and the bottom hinge 40 is folded along center line A—A, so that tabletop sections 42 and 44 are adjacent to each other. The clasp 70 and clasp holder 72 are then engaged, and the detachable transporting wheels 50 and 52 are then connected to side perimeter walls 34 and 36, where then the user then uses handle 74 to pull the collapsed gun stand table 10 over the ground 18 to a vehicle trunk. The gun stand table 10 is now in a compact configuration and can be placed in storage, as shown in FIG. 4. The gun stand table 10 is easily cleaned and maintained, as all of its component parts are made of plastic, fiberglass, aluminum, or stainless steel.

ADVANTAGES OF THE PRESENT INVENTION

Accordingly, an advantage of the present invention is that it provides for a collapsible and portable gun stand table which is light-weight, easily collapsed for storage and easily stabilized in a fully assembled or partially assembled mode for operational use by the shooter when hunting or target shooting.

Another advantage of the present invention is that it provides for a collapsible and portable gun stand table that has collapsible, foldable and adjustable telescoping legs for varying the height of the gun stand table on flat or rough terrain.

Another advantage of the present invention is that it provides for a collapsible and portable gun stand table that has a firearm support rail which is adjustable in the vertical and horizontal planes and is rotatable 360° degrees relative to the support table.

Another advantage of the present invention is that it provides for a collapsible and portable gun stand table having various accessories for ease of operational use by a shooter, such as removable wheels for transporting the table over a variety of terrains, and a plurality of drawers for storing of gun materials.

Another advantage of the present invention is that it provides for a collapsible and portable gun stand table having a center cutout opening for better positioning and accessing the firearm support rail when using a rifle or pistol, and a center support rail tray (if needed) as an elevational device for supporting a rifle when hunting which is interchangeable with the center storage drawer.

An even further advantage of the present invention is that it provides for a collapsible and portable gun stand table that can be mass produced in an automated and economical manner and is readily affordable by the consumer/user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A collapsible and portable gun stand table, comprising:

a) a table having a tabletop with top and bottom surfaces;

b) at least one channel opening formed in said tabletop;

c) firearm support means having a horizontal section and a vertical section wherein said horizontal section is used for supporting a firearm and said vertical section extends through said channel opening;

d) a gear housing for supporting said firearm support means on said tabletop and being movable within said channel opening to allow for lateral, vertical and rotational movement of said firearm support means relative to said tabletop;

e) a plurality of adjustable legs pivotally attached to said tabletop;

f) said tabletop having stabilizing means thereon for allowing said table to rest on said stabilizing means; and g) means for folding said tabletop into sections.

2. A gun stand table in accordance with claim 1, further including a padded collar component disposed on said horizontal section of said firearm support means for supporting the firearm barrel.

3. A gun stand table in accordance with claim 2, wherein said padded collar component is shaped for receiving and holding the contoured shape of a rifle stock.

4. A gun stand table in accordance with claim 1, wherein each of said adjustable legs include at least one telescoping leg section for extending outwardly from an outer support leg section for increasing the height of said tabletop when the user is in a crouching, kneeling, sitting, or standing position.

5. A gun stand table in accordance with claim 4, wherein one end of said telescoping leg section is connected to a castor component used for leveling said adjustable leg to a particular terrain.

6. A gun stand table in accordance with claim 4, wherein said telescoping leg sections include a plurality of adjustment holes each for receiving a retractable adjustment button for adjusting said adjustable legs to a desired height.

7. A gun stand table in accordance with claim 1, wherein said adjustable legs are pivotally attached to said tabletop by means of mounting brackets each located in the corner areas of said tabletop.

8. A gun stand table in accordance with claim 1, wherein said vertical section of said firearm support means has a second vertical section for detachably connecting to said vertical section for extending the height of said firearm support means when the user is in a standing position.

9. A gun stand table in accordance with claim 1, further including at least one storage drawer for storing gun accessories and being mounted on the bottom surface of said tabletop.

10. A gun stand table in accordance with claim 1, further including a cut-out opening located on said tabletop for allowing the torso portion of the user to have closer access in using said firearm support means when firing shots from a firearm.

11. A gun stand table in accordance with claim 1, further including a level attached to one of said perimeter walls for leveling said tabletop to a horizontal plane when adjusting said adjustable legs on an uneven terrain.

12. A gun stand table in accordance with claim 1, further including a second firearm support means adjustably mounted on the bottom surface of said tabletop.

13. A gun stand table in accordance with claim 1, further including transporting wheels and a handle mounted on one of said perimeter walls for transporting said gun stand table.

14. A gun stand table in accordance with claim 1, further including closing means for closing the two sections of said tabletop.

15. A gun stand table in accordance with claim 1, further including a pair of removable rubber bumpers detachably mounted on one of said perimeter walls.

16. A gun stand table in accordance with claim 1, wherein said tabletop and said adjustable legs have camouflage patterns thereon for disguising said gun stand table when used for hunting.

17. A gun stand table in accordance with claim 1, wherein said tabletop, said adjustable legs, and said firearm support means may be made of aluminum, stainless steel, fiberglass, or plastic.

18. A gun stand table in accordance with claim 1, further including a buttstock support assembly on said tabletop for receiving and supporting a rifle buttstock.

* * * * *